US010446093B2

(12) United States Patent
Lee et al.

(10) Patent No.: US 10,446,093 B2
(45) Date of Patent: Oct. 15, 2019

(54) USER TERMINAL DEVICE AND METHOD FOR ADJUSTING LUMINANCE THEREOF

(71) Applicant: SAMSUNG ELECTRONICS CO., LTD., Suwon-si (KR)

(72) Inventors: Seung-heon Lee, Suwon-si (KR); Se-hoon Kim, Suwon-si (KR); Jee-young Yeom, Yongin-si (KR); Won-hee Choe, Seoul (KR); Han-tak Kwak, Seongnam-si (KR); Seo-young Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 24 days.

(21) Appl. No.: 15/091,163

(22) Filed: Apr. 5, 2016

(65) Prior Publication Data

US 2016/0372053 A1 Dec. 22, 2016

Related U.S. Application Data

(60) Provisional application No. 62/181,380, filed on Jun. 18, 2015.

(30) Foreign Application Priority Data

Oct. 12, 2015 (KR) ..... 10-2015-0142128

(51) Int. Cl.
*G09G 3/34* (2006.01)

(52) U.S. Cl.
CPC ..... *G09G 3/342* (2013.01); *G09G 3/3406* (2013.01); *G09G 2320/0626* (2013.01);
(Continued)

(58) Field of Classification Search
CPC ..... G09G 3/3406; G09G 3/342; G09G 2360/144; G09G 2320/0626
See application file for complete search history.

(56) References Cited

U.S. PATENT DOCUMENTS 7,110,062 B1 * 9/2006 Whitted ..... G02F 1/1336 349/62
8,405,686 B2 3/2013 Tanizoe et al.
(Continued)

FOREIGN PATENT DOCUMENTS

JP 2007-279179 A 10/2007
JP 2010-91816 A 4/2010
(Continued)

OTHER PUBLICATIONS

Search Report dated Sep. 30, 2016, issued by the International Searching Authority in counterpart International Patent Application No. PCT/KR2016/006278 (PCT/ISA/210).
(Continued)

*Primary Examiner* — Michael A Faragalla
*Assistant Examiner* — Chayce R Bibbee
(74) *Attorney, Agent, or Firm* — Sughrue Mion, PLLC

(57) ABSTRACT

A user terminal device is provided. The user terminal device includes a display, a first sensor provided on a front surface of the user terminal device and configured to detect a front illumination, a second sensor provided on a rear surface of the user terminal device and configured to detect a rear illumination, and a controller configured to adjust a luminance of the display based on the front illumination detected by the first sensor and the rear illumination detected by the second sensor.

17 Claims, 22 Drawing Sheets

(52) U.S. Cl.
CPC ..... *G09G 2320/0653* (2013.01); *G09G 2320/0686* (2013.01); *G09G 2360/144* (2013.01)

(56) References Cited

U.S. PATENT DOCUMENTS

| | | | | |
|---|---|---|---|---|
| 2006/0125849 | A1* | 6/2006 | Kubota | G09G 3/22 345/690 |
| 2008/0078921 | A1 | 4/2008 | Yang et al. | |
| 2008/0208551 | A1 | 8/2008 | Kerofsky et al. | |
| 2008/0224988 | A1* | 9/2008 | Whang | G09G 3/3406 345/102 |
| 2010/0090996 | A1 | 4/2010 | Chou et al. | |
| 2010/0201716 | A1 | 8/2010 | Tanizoe et al. | |
| 2011/0193872 | A1 | 8/2011 | Biernath et al. | |
| 2013/0271508 | A1* | 10/2013 | Kaneko | G09G 5/10 345/690 |
| 2013/0300911 | A1* | 11/2013 | Beckman | G02B 27/0101 348/335 |
| 2014/0285477 | A1* | 9/2014 | Cho | G09G 3/2003 345/207 |

FOREIGN PATENT DOCUMENTS

| | | | |
|---|---|---|---|
| JP | 2014-202941 | A | 10/2014 |
| KR | 10-1088264 | B1 | 11/2011 |
| KR | 10-1325977 | B1 | 11/2013 |

OTHER PUBLICATIONS

Written Opinion dated Sep. 30, 2016, issued by the International Searching Authority in counterpart International Patent Application No. PCT/KR2016/006278 (PCT/ISA/237).
Communication dated Apr. 5, 2018, issued by the European Patent Office in counterpart European Patent Application No. 16811884.2.
Communication dated Jul. 11, 2019 issued by the Korean Intellectual Property Office in counterpart Korean Application No. 10-2015-0142128.

* cited by examiner

FIG. 5B

520

| | SECOND SENSOR INSTANTANEOUS VARIATION > 0 | SECOND SENSOR INSTANTANEOUS VARIATION = 0 | SECOND SENSOR INSTANTANEOUS VARIATION < 0 |
|---|---|---|---|
| FIRST SENSOR INSTANTANEOUS VARIATION > 0 | True | False | False |
| FIRST SENSOR INSTANTANEOUS VARIATION = 0 | False | False | False |
| FIRST SENSOR VARIATION = 0 VARIATION < 0 | False | False | True |

FIG. 9B

| | VALUE OBTAINED BY CORRECTING ILLUMINATION FOR EACH INCLINATION |
|---|---|
| INCLINATION 0°,360° | |
| INCLINATION 10° | |
| INCLINATION 20° | |
| INCLINATION 30° | |
| .... | |
| INCLINATION 180° | |
| INCLINATION 190° | |
| INCLINATION 200° | |
| .... | |
| INCLINATION 330° | |
| INCLINATION 340° | |
| INCLINATION 350° | |

925

Lookup Table

1035

ADJUST FRONT/REAR SURFACE WEIGHT FOR EACH X-AXIS ANGLE

| DEGREE | FIRST SENSOR | SECOND SENSOR |
|---|---|---|
| -45°~45° | 100% | 0% |
| +45°~+135° | 50% | 50% |
| +135°~-135° | 0% | 100% |
| -135°~-45° | 50% | 50% |

USER TERMINAL DEVICE AND METHOD FOR ADJUSTING LUMINANCE THEREOF

CROSS-REFERENCE TO RELATED APPLICATIONS

This application claims the benefit of U.S. Provisional Patent Application No. 62/181,380, filed on Jun. 18, 2015, in the U.S. Patent and Trademark Office, and priority from Korean Patent Application No. 10-2015-0142128, filed on Oct. 12, 2015, in the Korean Intellectual Property Office, the disclosures of which are incorporated herein by reference in their entirety.

BACKGROUND

Field

Apparatuses and methods consistent with the exemplary embodiments relate to a user terminal device and a method for adjusting luminance thereof, and more particularly, to a user terminal device for supporting a function of detecting surrounding illumination and a method for adjusting luminance thereof.

Description of the Related Art

By virtue of the development of electronics, various types of electronic apparatuses have been developed and have become widely popular. In particular, display apparatuses such as mobile devices and televisions have become commonplace and have been rapidly developed in the last several years.

Due to the proliferation of smart phones and tablet devices, mobile display apparatuses are frequently used for extended periods of time. As a result, mobile display apparatuses are used in various illumination environments, and due to the characteristics of a mobile device, visibility according to display luminance has attracted attention. Accordingly, although most mobile display apparatuses provide a function for automatically changing luminance according to peripheral illumination, illumination is measured using only a single optical sensor, and it is therefore difficult to accurately estimate an illumination environment.

SUMMARY

Exemplary embodiments overcome the above disadvantages and other disadvantages not described above. Also, the exemplary embodiments are not required to overcome the disadvantages described above, and an exemplary embodiment may not overcome any of the problems described above.

The exemplary embodiments provide a user terminal device and a method for adjusting luminance thereof, for enhancing visibility of a displayed image by adjusting an output luminance value of a display in consideration of rear illumination as well as front illumination.

According to an aspect of an exemplary embodiment, a user terminal device includes a display, a first sensor provided on a front surface of the user terminal device and configured to detect emitted light, a second sensor provided on a rear surface of the user terminal device and configured to detect emitted light, and a controller configured to adjust luminance of the display based on front illumination detected through the first sensor and rear illumination detected through the second sensor.

The controller may determine whether an illumination space is changed based on instantaneous variation of the front illumination and instantaneous variation of the rear illumination, and upon determining that the illumination space is changed, the controller may adjust the luminance of the display so as to correspond to the changed illumination space.

The controller may determine that the illumination space is changed and adjusts the luminance of the display at a time point when the illumination space is changed when the instantaneous variation of the front illumination and the instantaneous variation of the rear illumination are preset threshold values or more, respectively and variation directions thereof are identical to each other.

When the instantaneous variation of the front illumination and the instantaneous variation of the rear illumination are positive numbers, the controller may determine that the illumination space is relatively changed to a light space from a dark space, and when the instantaneous variation of the front illumination and the instantaneous variation of the rear illumination are negative numbers, the controller may determine that the illumination space is relatively changed to a dark space from a light space.

The controller may determine a backlight situation based on a comparison result of the front illumination and the rear illumination, and when a current situation is a backlight situation, the controller may adjust the luminance of the display so as to correspond to the backlight situation.

Upon determining the current situation is the backlight situation, the controller may upward adjust the luminance of the display compared with current luminance.

The controller may calculate intensity of backlight upon determining that the current situation is the backlight situation and calculates a value obtained by upward adjusting luminance based on the intensity of the backlight.

The controller may determine intensity of the backlight based on at least one of a ratio of the front illumination and the rear illumination, a difference of the front illumination and the rear illumination, and a preset mathematical calculation combination of the front illumination and the rear illumination.

Upon determining that the current situation is the backlight situation, the controller may adjust the luminance of the display based on the rear illumination or adjust the luminance of the display to a luminance value calculated by applying a higher weight than the front illumination to the rear illumination.

In this case, the first sensor and the second sensor may each be embodied as at least one of an illumination sensor, an RGB sensor, a white sensor, an IR sensor, an IR+RED sensor, an HRM sensor, and a camera.

The first sensor may be embodied as an RGB sensor and the second sensor is embodied as an HRM sensor, and the controller may scale a sensing value sensed by the HRM sensor based on characteristic of an illumination of a space in which the user terminal device is positioned and uses a scaled value as the rear illumination.

According to another aspect of an exemplary embodiment, a method for adjusting luminance of a user terminal device including a first sensor provided on a front surface of the user terminal device and configured to detect emitted light and a second sensor provided on a rear surface of the user terminal device and configured to detected emitted light includes detecting light emitted through the first sensor and the second sensor, and adjusting luminance of a display provided on the front surface based on front illumination detected through the first sensor and rear illumination detected through the second sensor.

The adjusting may include determining whether an illumination space is changed based on instantaneous variation of the front illumination and instantaneous variation of the rear illumination, and upon determining that the illumination space is changed, adjusting the luminance of the display so as to correspond to the changed illumination space.

The adjusting may include determining that the illumination environment is changed and adjusting the luminance of the display at a time point when the illumination environment is changed when the instantaneous variation of the front illumination and the instantaneous variation of the rear illumination are preset threshold values or more, respectively and variation directions thereof are identical to each other.

The adjusting may include, when the instantaneous variation of the front illumination and the instantaneous variation of the rear illumination are positive numbers, determining that the illumination space is relatively changed to a light space from a dark space, and when the instantaneous variation of the front illumination and the instantaneous variation of the rear illumination are negative numbers, determining that the illumination space is relatively changed to a dark space from a light space.

The adjusting may include determining a backlight situation based on a comparison result of the front illumination and the rear illumination, and when a current situation is a backlight situation, adjusting the luminance of the display so as to correspond to the backlight situation.

The adjusting may include, upon determining the current situation is the backlight situation, upward adjusting the luminance of the display compared with current luminance.

The adjusting may include calculating intensity of backlight upon determining that the current situation is the backlight situation and calculating a value obtained by upward adjusting luminance based on the intensity of the backlight.

The adjusting may include calculating intensity of the backlight based on at least one of a ratio of the front illumination and the rear illumination, a difference of the front illumination and the rear illumination, and a preset mathematical calculation combination of the front illumination and the rear illumination.

According to another aspect of an exemplary embodiment, a computer readable recording medium has recorded thereon a program for executing a method for adjusting luminance of a user terminal device including a first sensor provided on a front surface of the user terminal device and configured to detect emitted light and a second sensor provided on a rear surface of the user terminal device and configured to detected emitted light, the method including detecting light emitted through the first sensor and the second sensor, and adjusting luminance of a display provided on the front surface based on front illumination detected through the first sensor and rear illumination detected through the second sensor.

According to the diverse exemplary embodiments, output luminance proper to an illumination environment may be adjusted by accurately estimating a changed illumination environment, and visibility of a displayed image may be enhanced.

According to another aspect of an exemplary embodiment, a user terminal device includes a display; a first sensor provided on a front surface of the user terminal device and configured to detect a front illumination; a second sensor provided on a rear surface of the user terminal device and configured to detect a rear illumination; and a controller configured to adjust a luminance of the display based on the front illumination detected by the first sensor and the rear illumination detected by the second sensor.

According to another aspect of an exemplary embodiment, a method of adjusting luminance of a user terminal device including a first sensor provided on a front surface of the user terminal device and configured to detect a front illumination and a second sensor provided on a rear surface of the user terminal device and configured to detected a rear illumination, includes: detecting the front illumination by the first sensor and the rear illumination by second sensor; and adjusting a luminance of a display provided on the front surface of the user terminal device based on the front illumination detected by the first sensor and the rear illumination detected by the second sensor.

According to another aspect of an exemplary embodiment, a computer readable recording medium has recorded thereon a program for executing a method for adjusting luminance of a user terminal device comprising a first sensor provided on a front surface of the user terminal device and configured to detect a front illumination and a second sensor provided on a rear surface of the user terminal device and configured to detected a rear illumination, the method including: detecting the front illumination by the first sensor and the rear illumination by the second sensor; and adjusting a luminance of a display provided on the front surface of the user terminal device based on the front illumination detected by the first sensor and the rear illumination detected by the second sensor.

According to another aspect of an exemplary embodiment, a user terminal device having an automatic luminance adjusting function includes a display provided on a first side of the user terminal device; a first sensor provided on the first side of the user terminal device and configured to measure a first received luminance; a second sensor provided on a second side of the user terminal device and configured to measure a second received luminance; and one or more processors configured to calculate a target display luminance based on the first received luminance and the second received luminance; and to automatically adjust a luminance of the display to the target display luminance.

The one or more processors may be further configured to identify a first illumination space having a first illumination environment and a second illumination space having a second illumination environment based on the first received luminance and the second received luminance. The one or more processors may be further configured to identify, based on the first received luminance and the second received luminance, a change from the first illumination environment to the second illumination environment, and to adjust the target display luminance in response to the change. The second surface may be opposite to the first surface, and the one or more processors may be further configured to increase the target display luminance in response to an increase in the second received luminance. The one or more processors may be further configured such that the target display luminance is calculated based on a difference between the second received luminance and the first received luminance. The display may be configured to display an image, and the one or more processors may be further configured to control a luminance of a first region of the image independently from a second region of the image. The user terminal may also include a proximity sensor provided on the second side of the user terminal device, and the one or more processors may be further configured to calculate the target display luminance based on a weighted combination of the first received luminance and the second received luminance. The one or more processors may be further configured to calculate the target display luminance based only on the first received luminance in response to a motion being detected by the proximity sensor. The one or more processors may be further configured to correct a value of the target display luminance based on a value returned from a lookup table. The second sensor may be further configured to measure a heart rate of a user.

Additional and/or other aspects and advantages will be set forth in part in the description which follows and, in part, will be obvious from the description, or may be learned by practice of the exemplary embodiments.

BRIEF DESCRIPTION OF THE DRAWINGS

The above and/or other aspects of the exemplary embodiments will be more apparent by describing certain exemplary embodiments with reference to the accompanying drawings, in which:

FIGS. 5A and 5B are diagrams illustrating a method for determining an illumination space according to an exemplary embodiment;

FIGS. 9A and 9B are diagrams illustrating a method for calculating illumination according to an exemplary embodiment;

DETAILED DESCRIPTION OF THE EXEMPLARY EMBODIMENTS

Figure 1A:
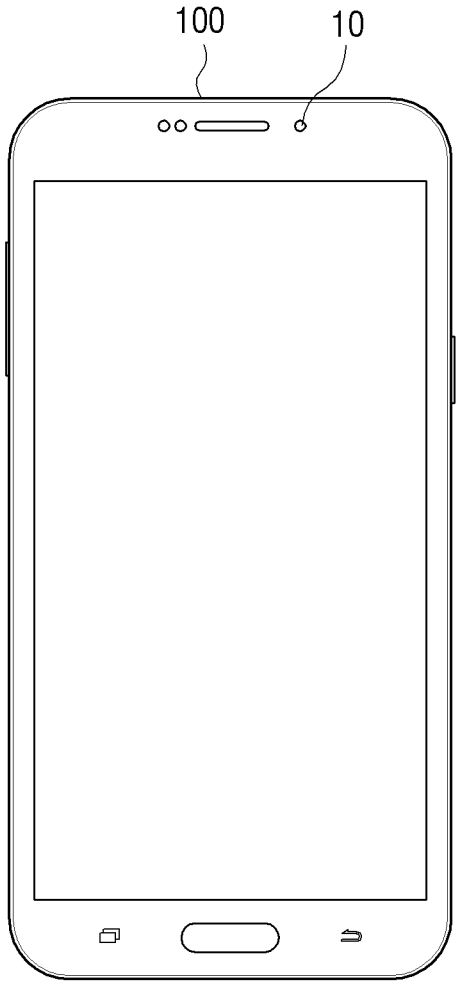
FIGS. 1A, 1B, and 1C are diagrams illustrating an example of a user terminal device according to an exemplary embodiment.
Figure 1B:
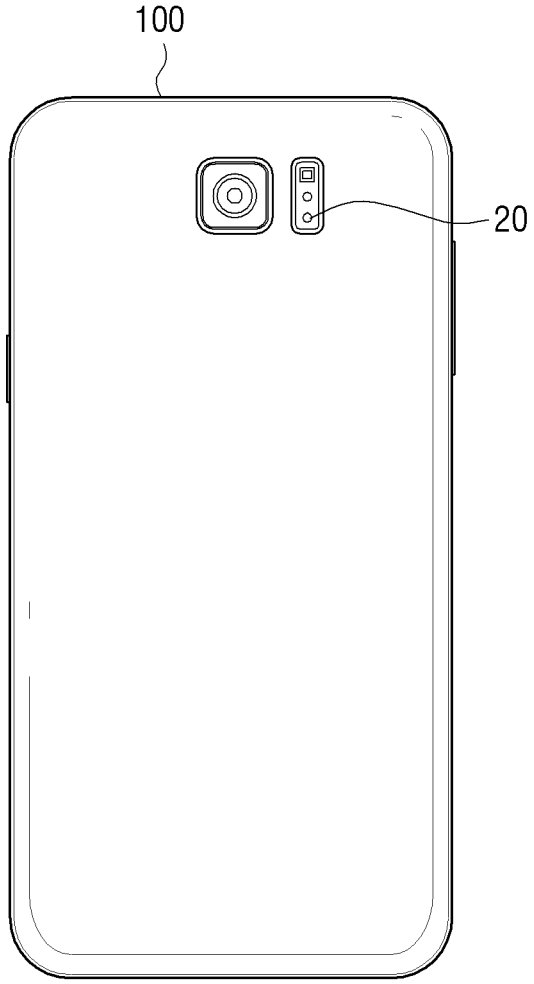
Figure 1C:
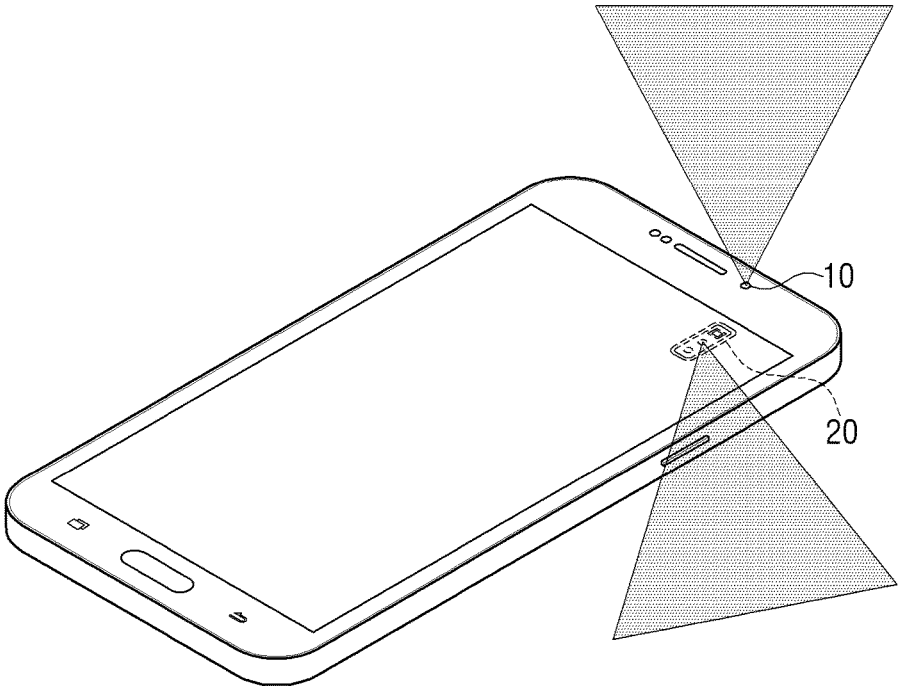

FIGS. 1A to 1C are diagrams illustrating an example of a user terminal device 100 according to an exemplary embodiment.

As illustrated in FIGS. 1A to 1C, the user terminal device 100 may be embodied as, but is not limited to, a cellular phone such as a smart phone, and may be any device that is carriable by a user and has a display function. Non-limiting examples may include a tablet personal computer (PC), a smart watch, a portable multimedia player (PMP), a personal digital assistant (PDA), a notebook PC, a television (TV), a head mounted display (HMD), and a near eye display (NED).

In order to provide a display function, the user terminal device 100 may be configured to include various types of displays such as a liquid crystal display (LCD), an organic light-emitting diode (OLED), a liquid crystal on silicon (LCoS), digital light processing (DLP), and a quantum dot (QD) display panel.

The user terminal device 100 according to an exemplary embodiment may provide a luminance automatic adjusting function for sensing surrounding illumination and automatically adjusting luminance of a display based on the sensed surrounding illumination to provide optimum display luminance.

In order to perform the luminance automatic adjusting function, the user terminal device 100 according to the exemplary embodiment may include illumination sensors 10 and 20 that are provided on front and rear surfaces, respectively, as illustrated in FIGS. 1A and 1B. For example, the illumination sensor 10 provided on the front surface may be provided on an upper bezel region of a screen, and the illumination sensor 20 provided on the rear surface may be provided to the right of a camera. However, this is merely an exemplary embodiment, and thus illumination sensors provided on the front and rear surfaces may be provided at various portions of the front/rear surfaces of the user terminal device 100. For example, the illumination sensor 20 may be provided on at least one portion of the upper, lower, right, left, and lateral surfaces of the user terminal device 100, instead of the rear surface. Here, the lateral surface may refer to a peripheral surface outside an edge on which a power key and the like illustrated in FIG. 1C are positioned. In general, the lateral surface may refer to a surface on which a volume key, a power key, a universal serial bus (USB) interface, an earphone interface, and the like are positioned.

Accordingly, the user terminal device 100 according to an exemplary embodiment may sense illumination in different directions based on the user terminal device 100, as illustrated in FIG. 1C.

Figure 2:
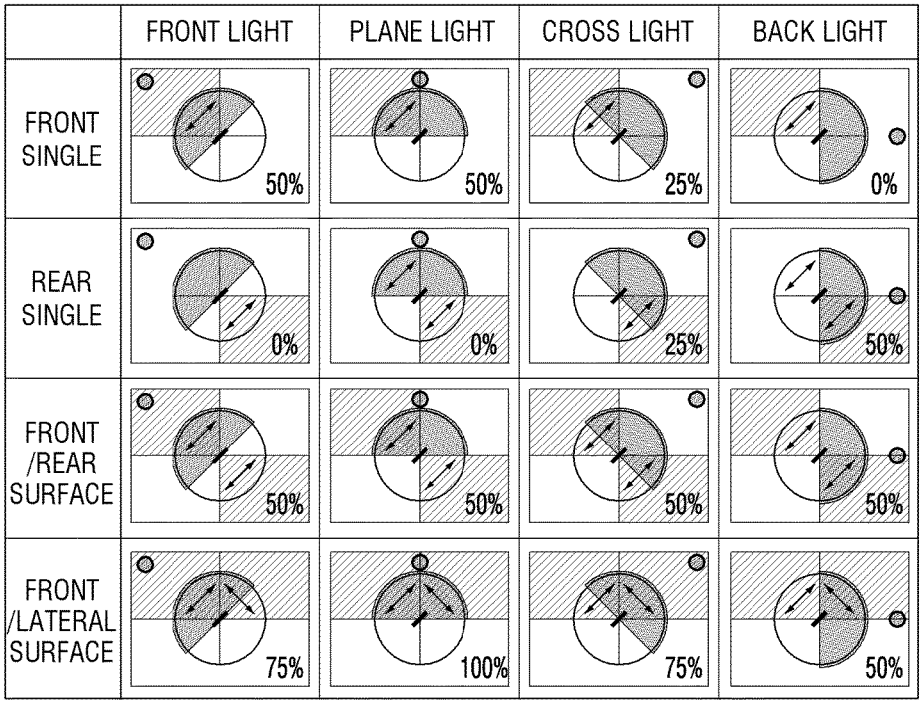
FIG. 2 is a diagram illustrating a sensing coverage range when a user terminal device includes a plurality of illumination sensors according to an exemplary embodiment.

FIG. 2 is a diagram illustrating a sensing coverage range when the user terminal device 100 includes a plurality of illumination sensors according to an exemplary embodiment.

FIG. 2 illustrates a sensing coverage range when one illumination sensor is provided and a sensing coverage range when two or more illumination sensors are provided in the user terminal device 100 such as a mobile device, in particular, a sensing coverage range when two or more illumination sensors are provided on a front/rear surface and a front/lateral surface.

As illustrated, a dark area may refer to an area on which sunlight is directly incident and a dashed area may refer to a range sensed by each sensor.

In this case, an overlap region between the dark areas indicating the area on which sunlight is incident and the dashed area indicating the range sensed by each sensor may be a sensing coverage region. Here, % number may refer to a sensing coverage rate of each case. That is, when two or more sensors are provided in the user terminal device 100 so as to sense illumination, a sensing coverage range is effective when respective sensors are provided on the front/rear surface or the front/lateral surface. However, the possible arrangements may be limited due to the design of the lateral surface, and thus, hereinafter, a case in which illumination sensors are provided on the front/rear surfaces, respectively, will be described. The same algorithm and driving principle according to exemplary embodiments may be applied to the case of the front/lateral surface.

Hereinafter, adjustment of luminance of a display using a plurality of illumination sensors included in the user terminal device 100 according to various exemplary embodiments will be described.

Figure 3A:
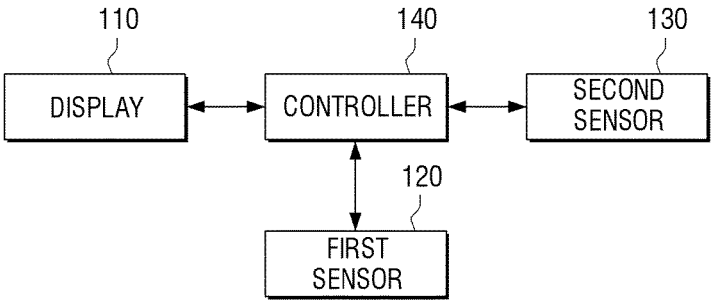
FIG. 3A is a block diagram illustrating a configuration of a user terminal device according to an exemplary embodiment.

FIG. 3A is a block diagram illustrating a configuration of the user terminal device 100 according to an exemplary embodiment.

Referring to FIG. 3A, the user terminal device 100 may include a display 110, a first sensor 120, a second sensor 130, and a controller 140.

The display 110 may provide various content images that are capable of being provided through the user terminal device 100. Here, the content image may include various contents such as an image, a video, a text, an application execution image containing the various contents, a graphic user interface (GUI) image, and the like.

As described above, the display 110 may be embodied as various types of displays such as a liquid crystal display, an organic light-emitting diode, liquid crystal on silicon (LCoS), and digital light processing (DLP). The display 110 may be formed of a transparent material and embodied as a transparent display for displaying information.

The display 110 may be embodied in the form of a touchscreen for configuration of an interlayer structure with a touchpad, and in this case, the display 110 may be used as a user interface as well as an output device.

The first sensor 120 may be provided on a front surface of the user terminal device 100 and may detect emitted light.

The first sensor 120 may detect at least one of various characteristics such as the illumination, intensity, color, incident direction, incident area, and distribution of light. In some embodiments, the first sensor 120 may be an illumination sensor, a temperature detection sensor, an optical amount sensing layer, a camera, or the like.

In particular, the first sensor 120 may be embodied as, but is not limited to, an illumination sensor for sensing RGB light, and thus may be any sensor for sensing light, such as a white sensor, an IR sensor, and an IR+RED sensor.

In this case, the illumination sensor may use various photoelectric cells, but may also use a photoelectric tube for measurement of very low illumination. For example, a CDS illumination sensor may be included in the user terminal device 100 and may detect illumination in opposite directions. In this case, the illumination sensor may be installed on at least one preset region of opposite surfaces of the user terminal device 100, but may also be installed in each pixel unit of the opposite surfaces. For example, an illumination sensor formed by enlarging a CMOS sensor so as to correspond to a size of the display 110 may be installed so as to measure an illumination state for each region or each pixel.

For example, the CDS illumination sensor may detect light around the user terminal device 100, and an A/D converter may convert a voltage acquired through the CDS illumination sensor into a digital value and transmit the digital value to a controller 140.

The second sensor 130 may be installed on a rear surface of the user terminal device 100 and may detect emitted light. However, according to an exemplary embodiment, the second sensor 130 may be provided on at least one of upper, lower, right, and left lateral surfaces instead of the rear surface. In addition, exemplary embodiments are not limited thereto, and thus the second sensor 130 may be provided at any other position as long as the second sensor 130 is configured to measure illumination in a different direction from the first sensor 120. For example, the second sensor 130 may be provided at a position at which illumination at an angle that is 90 degrees or more from the illumination detected by the first sensor 120 is capable of being detected.

The second sensor 130 may detect at least one of various characteristics such as the illumination, intensity, color, incident direction, incident area, and distribution of light. In some embodiments, the second sensor 130 may be an illumination sensor, a temperature detection sensor, an optical amount sensing layer, a camera, or the like.

In particular, the second sensor 130 may be embodied as, but is not limited to, an illumination sensor for sensing RGB light, and thus may be any sensor for sensing light, such as a white sensor, an IR sensor, and an IR+RED sensor.

The controller 140 may control an overall operation of the user terminal device 100.

The controller 140 may adjust luminance of the display 110 based on front illumination detected through the first sensor 120 and rear illumination detected through the second sensor 130. Alternatively, the controller 140 may include a micro control unit, a micom, a processor, a central processing unit (CPU), and the like. In addition, the controller 140 may be embodied as a System-on-Chip (SoC) including an image processing algorithm stored therein and embodied in the form of a field programmable gate array (FPGA). Here, a method for adjusting luminance may be performed by changing an output luminance value of the display 100. That is, a brightness value of a backlight or OLED installed in the display 110 may be adjusted. However, as necessary, a method for performing image processing on displayed content to change a pixel luminance value (or a digital gray scale value of a pixel) may be used. However, as necessary, it may be possible to further consider various surrounding environment information items including a surrounding environment other than illumination, for example, a power state of the user terminal device 100, a user state (sleep, reading, etc.), place information, and time information.

According to an exemplary embodiment, the controller 140 may determine whether an illumination space is changed based on instantaneous variation of front illumination detected through the first sensor 120 and instantaneous variation of rear illumination detected through the second sensor 130. The controller 140 may adjust luminance of the display 110 so as to correspond to the changed illumination space upon determining that the illumination space is changed. Here, the illumination space may be a physically separated space, for example, an office/lobby, a room/living room, and an indoor/outdoor area. In this regard, a visual system (hereinafter, VS) of a user may allow the user to feel as if illumination is uniform across the illumination space. For example, although a part of the illumination space may be under many lamps, and another part of the illumination space may be under only a few lamps, the user may still feel as if the parts are similar illumination spaces. Accordingly, according to an exemplary embodiment, the same display luminance may be maintained in the same space, and when a space is changed, the luminance may be immediately or gradually changed to an optimum luminance proper to the corresponding space. However, as necessary, the illumination space may refer to a space that provides a specific illumination environment. For example, when an office space is very large, a space that is close to a window and illuminated by a large amount of light and a space that is far from the window and illuminated by a small amount of light may provide much different environments, and thus the spaces may be considered different illumination spaces according to exemplary embodiments.

In detail, when the instantaneous variation of the front illumination and the instantaneous variation of the rear illumination are equal to or more than preset threshold values, respectively, and variation directions thereof are identical to each other, the controller 140 may determine that an illumination space is changed and adjust luminance of the display 110 at a time point when the illumination space is changed.

According to an exemplary embodiment, the controller 140 may determine whether a current situation is a backlight situation based on a comparison result of the front illumination and the rear illumination, and upon determining that the current situation is the backlight situation, the controller 140 may adjust display luminance so as to correspond to the backlight situation.

In detail, the controller 140 may determine whether the current situation is the backlight situation based on at least one of a difference between the front illumination and the rear illumination, a ratio of the front illumination and the rear illumination, and a preset mathematical calculation combination of the front illumination and the rear illumination. For example, when the rear illumination is greater than the front illumination by a preset threshold value or more, the controller 140 may determine that the current situation is the backlight situation. When a preset reference value for determination of the backlight situation is "front illumination/rear illumination=a", the controller 140 may determine that the current situation is the backlight situation in the case of front illumination/rear illumination<a. Here, 'a' may be acquired from an experimental value or the like or may be simply set to 1.

In addition, the controller 140 may determine an intensity of the backlight based on at least one of a difference between the front illumination and the rear illumination, a ratio of the front illumination and the rear illumination, and a mathematical calculation combination of the front illumination and the rear illumination. For example, the controller 140 may determine the intensity of the backlight based on a value of "front illumination/rear illumination" or based on a value of "front illumination−rear illumination".

Upon determining that the current situation is the backlight situation, the controller 140 may adjust luminance of the display 110 to be higher than current luminance.

In detail, the controller 140 may calculate a value obtained by raising luminance based on intensity of backlight upon determining that the current situation is the backlight situation. For example, the controller 140 may increase the value obtained by raising luminance as intensity of backlight is increased. This is because visibility of a display image is further reduced since the display 110 provided on a front surface of the user terminal device 100 is darker as the intensity of backlight is increased.

In addition, upon determining that the current situation is the backlight situation, the controller 140 may adjust luminance of the display 110 based on the rear illumination. In detail, upon determining that the current situation is the backlight situation, the controller 140 may calculate the value obtained by raising luminance based on only the rear illumination.

In addition, upon determining that the current situation is the backlight situation, the controller 140 may adjust the luminance of the display 110 to a luminance value calculated by applying a higher weight than the front illumination to the rear illumination.

In addition, in some embodiments of the first and second sensors, as necessary, the controller 140 may perform correction (e.g., scaling) on a sensing value. For example, when the second sensor is embodied as a HRM sensor, the controller 140 may scale a sensing value sensed by the HRM sensor and use the scaled sensing value as rear illumination based on illumination characteristics of a space in which the user terminal device 100 is positioned, which will be described in detail.

When surrounding illumination, that is, the front illumination and the rear illumination, satisfy a preset condition, the controller 140 may adjust a luminance value of the display 110 so as to be gradually increased or decreased to a target luminance value from an initial luminance value. For example, this may correspond to a case in which a light surrounding environment of a display is abruptly changed to a specific illumination (e.g., 100 lux) or less, a case in which a dark display screen with a specific illumination or less is converted to a light screen, or a case in which a display screen is converted into an activated state from an inactivated state when surrounding illumination is a specific illumination or less.

In addition, when surrounding illumination, that is, the front illumination and the rear illumination, satisfy a preset condition, the controller 140 may divide an image into at least one region and a remaining region based on an attribute of the content of the display and may separately control luminance values of the respective separated regions. Here, the luminance values of the respective regions may include at least one of a maximum brightness value, a maximum color value, and an average brightness value of the displayed content.

In detail, the controller 140 may separately control the luminance of each region such that the luminance of information displayed in at least one region is different from the luminance of information displayed on the remaining region. Alternatively, the controller 140 may separately control the luminance of each region such that the luminance of the information displayed in at least one region reaches a target luminance value earlier than the luminance of the information displayed in the remaining region. Here, target luminance values of the respective regions may be the same or different. In addition, the controller 140 may differently apply a shape of a gamma curve applied to at least one region and a shape of a gamma curve applied to the remaining region. Here, a gamma curve (or a gamma table) may refer to a table showing a relationship between a gray scale and display luminance of an image, and, for example, the gamma curve may refer to a table showing a relationship between a gray scale and display luminance of an image based on a case in which the user terminal device 100 emits light with a maximum luminance level. For example, when a gamma curve in a logarithmic form is applied to a region of interest and a gamma curve in an exponential function form is applied to a region of non-interest, the user may feel as if the region of interest is first recognized and then the region of non-interest is gradually recognized.

The controller 140 may provide a user interface (UI) image for adjusting a luminance value of the display 110 according to a preset event on one region of the display 110. Accordingly, in order to change the adjusted luminance value according to an exemplary embodiment, a user may manually adjust the luminance value of the display through the UI image. In this case, the controller 140 may provide a graphic user interface (GUI) indicating an original luminance value of corresponding content on the UI image. Accordingly, the user may appropriately adjust the luminance value of the display through the corresponding GUI.

In the aforementioned exemplary embodiments, although the controller 140 adjusts a luminance adjusting value according to a preset formula, this is merely an exemplary embodiment, and thus the controller 140 may calculate the luminance adjusting value based on pre-stored data. For example, a luminance adjusting value (e.g., a target luminance value or a luminance value to be increased or reduced) corresponding to the number of cases according to the front illumination and the rear illumination may be stored in the form of a LUT, and a luminance adjusting value corresponding to a current situation may be selected based on the stored LUT.

Figure 3B:
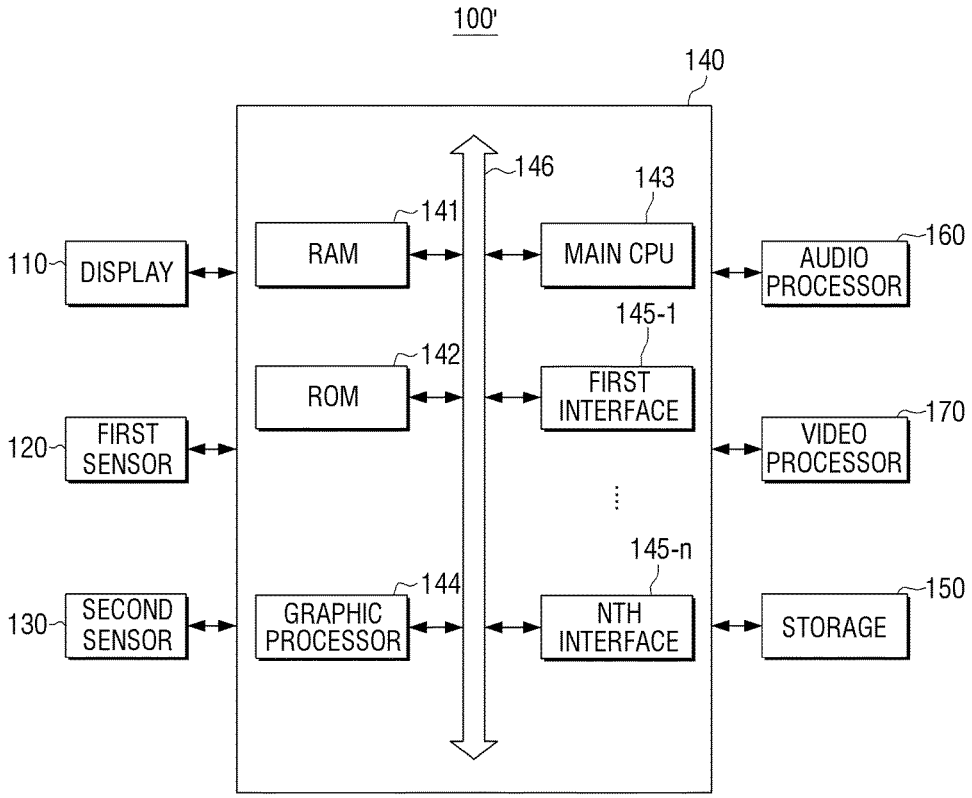
FIG. 3B is a block diagram illustrating a detailed configuration of the user terminal apparatus illustrated in FIG. 3A.

FIG. 3B is a block diagram illustrating a detailed configuration of the user terminal apparatus illustrated in FIG. 3A.

Referring to FIG. 3B, a user terminal apparatus 100' may include the display 110, the first sensor 120, the second sensor 130, the controller 140, a storage 150, an audio processor 160, and a video processor 170. A detailed description of repeated components of components illustrated in FIG. 3A among components illustrated in FIG. 3B will be omitted here.

The controller 140 may include a random access memory (RAM) 141, a read only memory (ROM) 142, a main central processing unit (CPU) 143, a graphic processor 144, first to $n^{th}$ interfaces 145-1 to **145-*n*, and a bus 146**.

The RAM 141, the ROM 142, the main CPU 143, the graphic processor 144, the first to $n^{th}$ interfaces 145-1 to **145-*n*, and the like may be connected to each other through the bus 146**.

The first to $n^{th}$ interfaces 145-1 to **145-*n*** may be connected to the aforementioned components. One of the interfaces may be a network interface that is connected to an external apparatus though a network.

Figure 4:
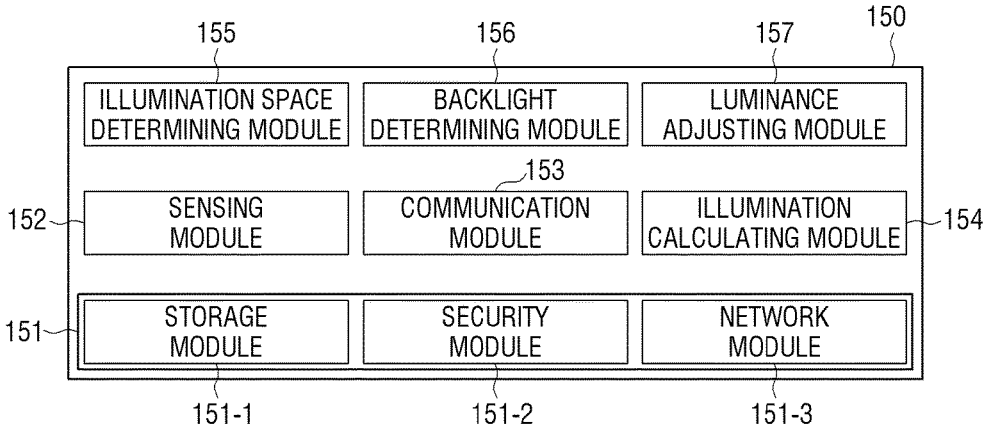
FIG. 4 is a diagram illustrating various modules stored in a storage.

The main CPU 143 may access the storage 150 and perform a system booting operation using an operating system (O/S) stored in the storage 150. In addition, the main CPU 143 may perform various operations using various modules, various programs, content, data, and the like which are stored in the storage 150. In particular, the main CPU 143 may perform an operation according to various exemplary embodiments based on an illumination calculating module 154, the illumination space determining module 155, a backlight determining module 156, and a luminance adjusting module 157, which are illustrated in FIG. 4.

The ROM 142 may store a command set and the like, for the system booting operation. In response to a turn-on command being input to the main CPU 143 to supply power to the main CPU 143, the main CPU 143 may copy the O/S stored in the storage 150 and execute the O/S to boot a system according to the command stored in the ROM 142. Upon completing the system booting operation, the main CPU 143 may copy various programs stored in the storage 150 to the RAM 141 and execute a program copied to the RAM 141 to perform various operations.

The graphic processor 144 may generate an image including various objects such as an icon, an image, a text, and the like using a subprocessor (not shown) and a renderer (not shown). The subprocessor (not shown) may calculate an attribute value such as a coordinate value, a shape, a size, and color, for displaying each object according to a layout of an image, based on a received control command. The renderer (not shown) may generate images of various layouts, including objects, based on the attribute values calculated by the subprocessor (not shown).

The aforementioned operation of the controller 140 may be executed according to the program stored in the storage 150.

The storage 150 may store various data items, such as an operating system (O/S) software module and various multimedia contents, for driving a broadcast receiving apparatus 200. In particular, the storage 150 may store luminance information and the like according to programs, and illumination and content characteristics of an illumination calculating module, an illumination space determining module, a luminance adjusting module, and the like. Hereinafter, a detailed operation of the controller 140 using various programs stored in the storage 150 will be described in detail.

FIG. 4 is a diagram illustrating various modules stored in a storage 150.

Referring to FIG. 4, the storage 150 may store software including a base module 151, a sensing module 152, a communication module 153, the illumination calculating module 154, an illumination space determining module 155, a backlight determining module 156, and the luminance adjusting module 157.

The base module 151 may refer to a basic module that processes a signal transmitted from each hardware item included in the user terminal apparatus 100' and transmits the signal to a higher layer module. The base module 151 may include a storage module 151-1 for managing a database (DB) or a register, a security module 151-2 for supporting certification, request permission, secure storage, and the like for hardware, and a network module 151-3 for supporting network connection.

The sensing module 152 may collect information from various sensors and analyze and manage the collected information. The sensing module 152 may include an illumination detection module, a touch recognition module, a head direction recognition module, a face recognition module, a voice recognition module, a motion recognition module, and the like.

The communication module 153 may communicate with an external device. The communication module 153 may include a messaging module such as a device module, a messenger program, a short message service (SMS) & multimedia message service (MMS) program, and an e-mail program, which are used in communication with an external device, and a telephone module including a call info aggregator program module, a VoIP module, and the like.

The illumination calculating module 154 may calculate illumination information according to a front illumination signal and a rear illumination signal, which are detected through the first sensor 120 and the second sensor 130. To this end, the illumination calculating module 154 may include a preset algorithm for converting the detected illumination signal into illumination information determinable by the controller 140.

The illumination space determining module 155 may determine a change in an illumination space in real-time based on surrounding illumination calculated by the illumination calculating module 154, that is, the front illumination and the rear illumination.

Figure 5A:
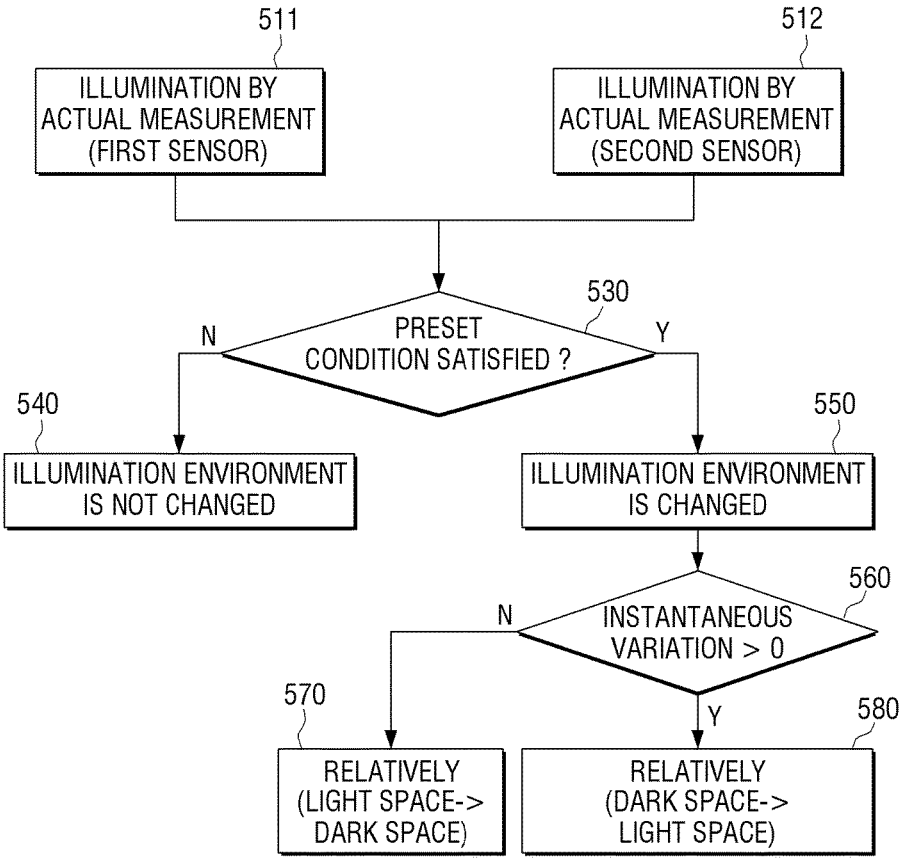

FIGS. 5A and 5B are diagrams illustrating a method for determining an illumination space according to an exemplary embodiment.

According to the method for determining an illumination space of the illumination space determining module 155 illustrated in FIG. 5A, instantaneous variation of illumination measured by the first sensor 120 and instantaneous variation of illumination measured by the second sensor 130 may be compared with each other to determine whether an illumination environment is changed.

Whether the illumination environment is changed may be determined according to whether instantaneous variation of illumination 511 measured by the first sensor 120 and instantaneous variation of illumination 512 measured by the second sensor 130 satisfy a preset condition (S520). In detail, the controller 140 may determine whether the instantaneous variation of the illumination 511 measured by the first sensor 120 and the instantaneous variation of the illumination 512 measured by the second sensor 130 are changed to respective specific threshold values or more, whether variation directions thereof are identical to each other, and whether the illumination space is changed based on the determination result.

In particular, when the instantaneous variation of the illumination 511 measured by the first sensor 120 and the instantaneous variation of the illumination 512 measured by the second sensor 130 are changed to respective specific threshold values or more, and when variation directions thereof are identical to each other (Y of 530), it may be determined that the illumination space is changed (550). Otherwise (N of 530), it may be determined that the illumination space is not changed (540).

For example, as shown in a table 520 illustrated in FIG. 5B, when the instantaneous variation of the first sensor 120 is increased to a specific threshold value or more and the instantaneous variation of the second sensor 130 is increased to a specific threshold value or more (in the case of 'True' in the table 520), it may be determined that the illumination space is changed. In addition, when instantaneous variation of the first sensor 120 is reduced to a specific threshold value or less and the instantaneous variation of the second sensor 130 is reduced to a specific threshold value or more (in the case of 'True' in the table 520), it may be determined that the illumination space is changed.

In this case, when the instantaneous variation of illumination measured by each sensor is a positive number (560), it may be determined that an illumination environment is changed to a light space from a dark space (580), and when the instantaneous variation of illumination measured by each sensor is a negative number, it may be determined that an illumination environment is changed to a dark space from a relatively light space (570). Here, a time point when instantaneous variation is a positive number or a negative number may be a time point when a space change occurs.

As described above, when change in an illumination space is determined using a plurality of illumination sensors, a time point when an illumination environment is changed may be determined in real-time. That is, it is impossible to accurately determine a time point when the illumination environment is changed using only a single illumination sensor, but according to an exemplary embodiment, sensing accuracy of change in an illumination space may be enhanced and measurement time may be reduced by using an additional sensor.

Referring back to FIG. 4, the backlight determining module 156 may determine a backlight situation and an intensity of the backlight based on surrounding illumination, that is, front illumination and rear illumination that are calculated by the illumination calculating module 154.

Figure 6:
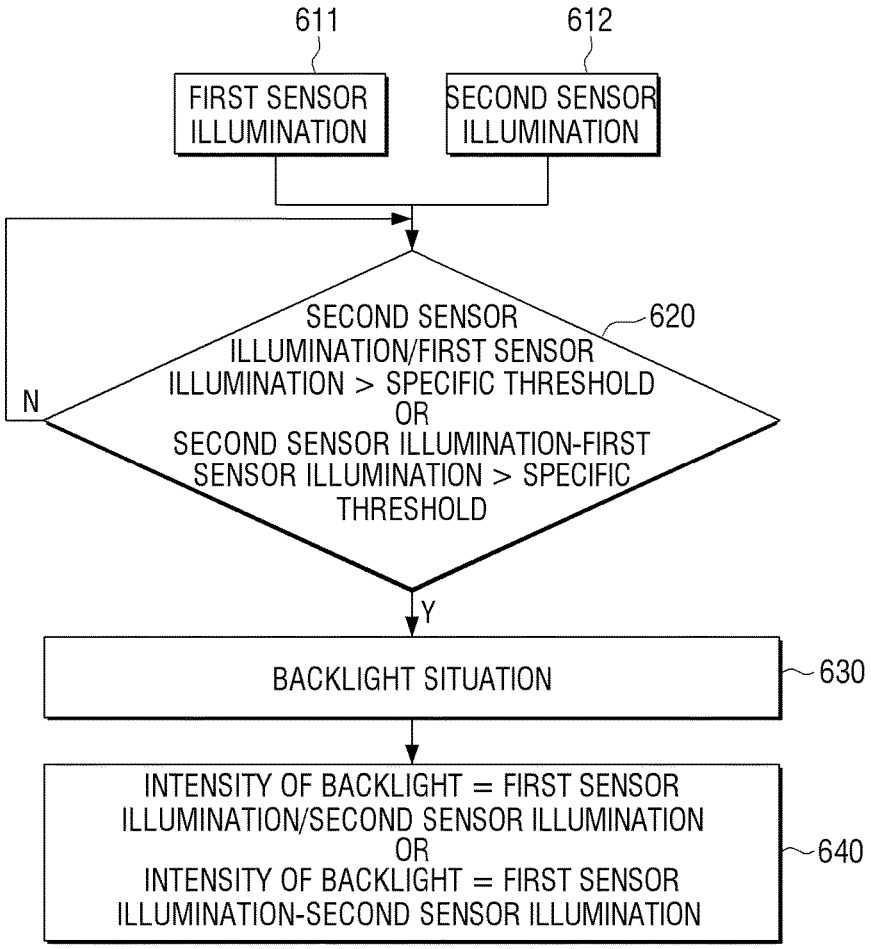
FIGS. 6 and 7 are diagrams illustrating a method for determining backlight according to an exemplary embodiment.
Figure 7:
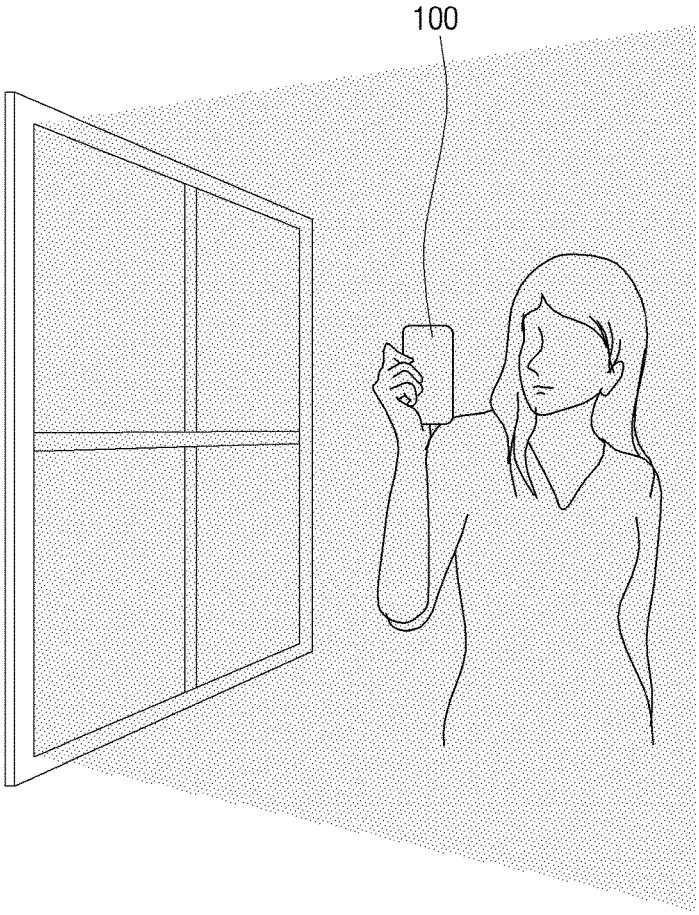

FIGS. 6 and 7 are diagrams illustrating a method for determining backlight according to an exemplary embodiment.

As illustrated in FIG. 7, visibility of a front display may be degraded due to light emitted from a rear surface of the user terminal device 100 in a backlight situation. Accordingly, according to an exemplary embodiment, luminance of display may be upward adjusted in a backlight situation.

In a method for determining backlight of the backlight determining module 156 illustrated in FIG. 6, a backlight situation and backlight intensity may be determined based on sizes of illumination 611 measured by the first sensor 120 and illumination 612 measured by the second sensor 130. For example, a backlight situation and backlight intensity may be determined based on at least one of a ratio, a difference value, and a mathematical calculation combination of front/rear illumination of the illumination 611 measured by the first sensor 120 and the illumination 612 measured by the second sensor 130.

In detail, when a ratio of the illumination 611 measured by the first sensor 120 to the illumination 612 measured by the second sensor 130 is greater than a preset threshold value (or is equal to or more than a preset threshold value) or a value obtained by subtracting the illumination 611 measured by the first sensor 120 from the illumination 612 measured by the second sensor 130 is greater than a preset threshold value (or is equal to or more than a preset threshold value) (620), a current situation is determined as a backlight situation (630).

In this case, an intensity of the backlight may be determined according to a ratio of the illumination 611 measured by the first sensor 120 to the illumination 612 measured by the second sensor 130, a value obtained by subtracting the illumination 611 measured by the first sensor 120 from the illumination 612 measured by the second sensor 130, a mathematical calculation combination of front/rear illumination, or the like (640).

Based on the calculated intensity of the backlight, a value obtained by increasing the luminance or a target luminance value may be calculated and luminance may be increased based on the calculated value, thereby enhancing visibility of display.

Referring back to FIG. 4, the luminance adjusting module 157 may adjust luminance of the display 110 based on at least one of output values of an illumination calculating module 145, the illumination space determining module 155, and the backlight determining module 156.

Figure 8A:
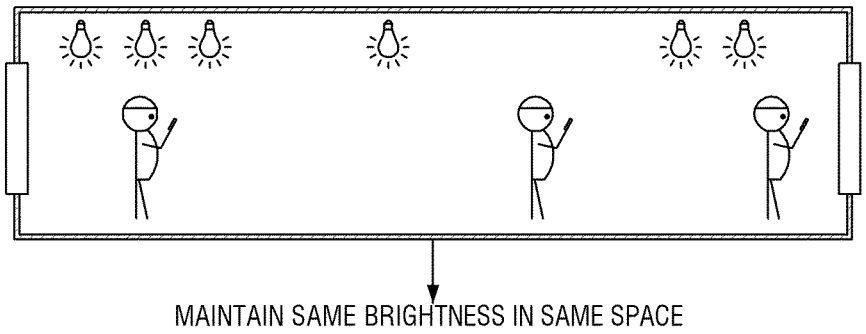
FIGS. 8A and 8B are diagrams illustrating a method for adjusting luminance according to various exemplary embodiments.
Figure 8B:
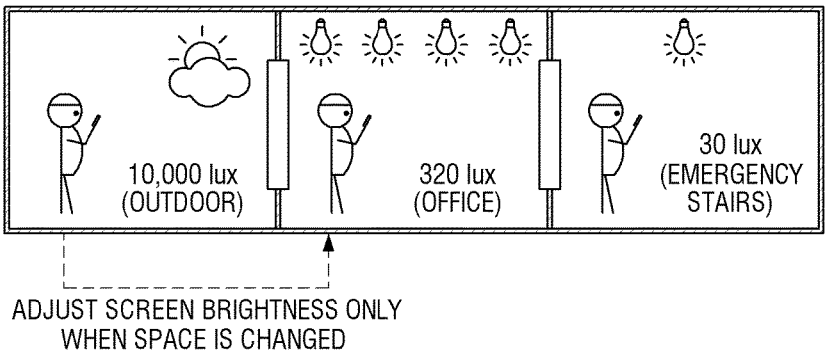

FIGS. 8A and 8B are diagrams illustrating a method for adjusting luminance according to various exemplary embodiments.

FIG. 8A illustrates the case in which a user moves in an office space. In this case, a visual system (hereinafter, VS) of a user may allow the user to feel as if illumination is uniform across the illumination space. For example, although a part of the illumination space may be under many lamps, and another part of the illumination space may be under only a few lamps, the user may still feel as if the parts are similar illumination spaces. Accordingly, constancy of 'the same display luminance' may be maintained in 'the same space'.

FIG. 8B illustrates the case in which a user moves in three different spaces. According to an exemplary embodiment, as described with reference to FIG. 7A, the same display luminance may be maintained in the same space, and when a space is changed, the luminance may be immediately or gradually changed to optimum luminance proper to the corresponding space.

Referring back to FIG. 3B, the user terminal apparatus 100' may include a touch sensor, a geomagnetic sensor, a gyro sensor, an acceleration sensor, a proximity sensor, a grip sensor, and the like. Accordingly, the user terminal apparatus 100' may detect various manipulation operations such as touch, rotation, inclination, pressure, proximity, and grip.

The touch sensor may be embodied as an electrostatic type sensor or a resistive type sensor. The electrostatic type sensor may refer to a sensor that calculates a touch coordinate by detecting nano electricity excited in the body of a user when a part of the user's body is touched on a display surface using a dielectric substance coated on the display surface. The resistive type sensor may refer to a touch sensor that includes two electrode plates installed in the user terminal device 100 and calculates a touch coordinate by detecting that upper and lower plates of a touched point contact each other such current flows while being touched by a user. In addition, an infrared ray detection method, a surface ultrasonic conduction method, an integral strain gauge method, a piezo effect method, or the like may be used to detect touch interaction.

In addition, the user terminal apparatus 100' may determine whether a touch object such as a finger or a stylus pen contacts or approaches a target using a magnetic and magnetic field sensor, an optical sensor, a proximity sensor, or the like instead of a touch sensor.

The geomagnetic sensor may be a sensor for detecting a rotation state, a moving direction, and the like of the user terminal apparatus 100'. The gyro sensor may be a sensor for detection of a rotational angle of the user terminal apparatus 100'. Both of the geomagnetic sensor and the gyro sensor may be included, but even if one of these is included, a rotation state of the user terminal apparatus 100' may be detected.

The acceleration sensor may be a sensor for detecting a movement acceleration degree in X and Y axes of the user terminal apparatus 100'.

The proximity sensor may be a sensor for detection of a motion of an object approaching a display surface without direct contact with the display surface. The proximity sensor may be embodied in the form of various types of sensors such as a high frequency oscillating type sensor that forms a high-frequency magnetic field and detects current induced by magnetic field characteristics changed in the case of proximity of an object, a magnetic type sensor using a magnet, and a capacitance type sensor for detecting electrostatic capacitance changed due to proximity of an object.

The grip sensor may be a sensor that is provided on a rear surface, an edge, and a handle portion irrespective of a touch sensor included in a touch screen of the user terminal apparatus 100' so as to detect user grip. The grip sensor may be embodied as a pressure sensor other than a touch sensor.

In addition, the user terminal apparatus 100' may further include the audio processor 160 for processing audio data, the video processor 170 for processing video data, a speaker (not shown) for outputting various notification sounds, voice messages, or the like as well as various audio data items processed by the audio processor 160, and a microphone (not shown) for receiving user voice or other sounds and converting the sounds into audio data.

Figure 9A:
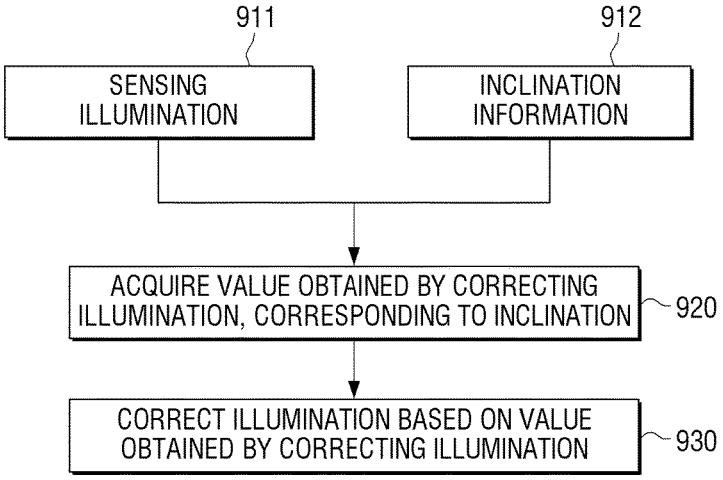

FIGS. 9A and 9B are diagrams illustrating a method for calculating illumination according to an exemplary embodiment.

According to an exemplary embodiment, in order to measure illumination, the user terminal apparatuses 100 and 100' may use inclination information detected by the gyro sensor, the geomagnetic sensor, the acceleration sensor, and the like.

In detail, as illustrated in FIG. 9A, the measured illumination may be corrected based on the sensing illumination 911 and the inclination information 912 detected by the gyro sensor, the geomagnetic sensor, the acceleration sensor, and the like. Here, the illumination information may be a single illumination measured by the first or second sensor 120 or 130.

In addition, a value obtained by correcting illumination, which corresponds to the inclination information 912, may be acquired (920) and the sensing illumination 911 may be corrected based on the acquired value obtained by correcting illumination (930).

For example, as illustrated in FIG. 9B, the value obtained by correcting illumination for each inclination may be stored in the form of a lookup table 925 and a illumination value that is actually measured in real time may be corrected based on the corresponding lookup table 925. Here, the lookup table 925 may be separately provided for each sensor included in the user terminal apparatuses 100 and 100'. For example, a corresponding lookup table may be provided based on sensing characteristics, a position in which a sensor is installed, and the like according to a sensor type. For example, a lookup table for correcting illumination measured by the first sensor 120 and a lookup table for correcting illumination measured by the second sensor 130 may be separately provided. The lookup table may be stored during manufacture of the user terminal apparatuses 100 and 100' but may be provided by a server (not shown) or updated.

Corrected illumination may be calculated according to "input illumination*illumination correction value for each inclination" but is not limited thereto, and thus may be calculated in various forms according to a type of an illumination correction value for each inclination. For example, when an illumination correction value for each inclination is stored as an illumination amount to be added or subtracted, the corrected illumination may be calculated in the form of "input illumination±illumination correction value for inclination".

As described above, inclination information may be used during measurement of illumination, thereby enhancing accuracy of an illumination measurement value.

Figure 10A:
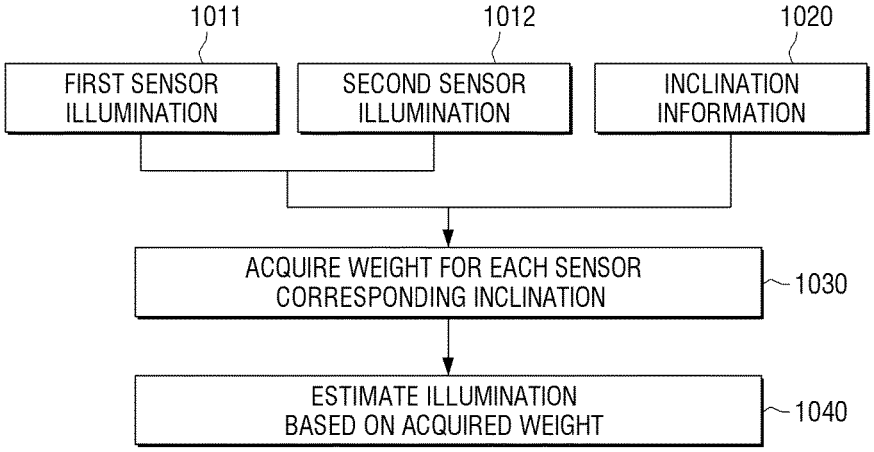
FIGS. 10A and 10B are diagrams illustrating a method for calculating illumination according to an exemplary embodiment.
Figure 10B:
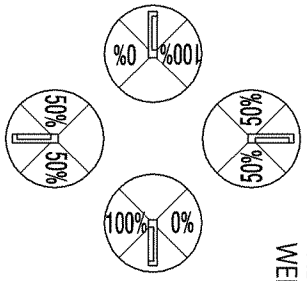

FIGS. 10A and 10B are diagrams illustrating a method for calculating illumination according to an exemplary embodiment.

As illustrated in FIG. 10A, illumination may be calculated based on illumination 1011 measured by the first sensor 120, illumination 1012 measured by the second sensor 130, and inclination information 1020.

In detail, a weight corresponding to each sensor corresponding to the inclination information 1020 may be acquired (1030) and illumination may be estimated based on the acquired weight for each sensor (1040).

This is because a value of illumination of the first sensor 120 and the second sensor 130 is changed according to a device inclination. For example, when a device is directed upward, a value for use of a front illumination sensor may be high, and when the device is directed downward, a value for use of a rear illumination may be high. As such, weights for summing two or more illumination sensors may be differentiated according to an inclination of the device.

For example, as illustrated in FIG. 9B, different weights to be applied to respective illuminations measured by the first sensor 120 and the second sensor 130 for each inclination (e.g., an X-axis angle) of the user terminal device 100 may be stored in the form of a lookup table 1035 and an illumination that is actually measured in real time may be corrected based on the corresponding lookup table 930. Here, the lookup table 1035 may be embodied in various forms in some embodiments. For example, an inclination range for applying the same weight, a weight applied to each inclination range, and the like may be differently set from the illustrated lookup table 1035. For example, a specific weight may be switched to "front illumination 100%/rear illumination 0%" or "front illumination 0%/rear illumination 100%".

A lookup table may be set in the form of a correction value to be added or subtracted according to an inclination instead of a weight. The lookup table may be stored during manufacture of the user terminal apparatuses 100 and 100' but may be provided by a server (not shown) or updated.

Estimated illumination may be calculated according to "(α*first sensor illumination)+(β*second sensor illumination)," wherein α and β are weights, but is not limited thereto. For example, when an illumination correction value for each inclination is stored as an amount of illumination to be added or subtracted, corrected illumination may be calculated according to "{(first sensor illumination-γ)+(second sensor illumination-δ)}/k," wherein γ and δ are correction values.

Figure 11:
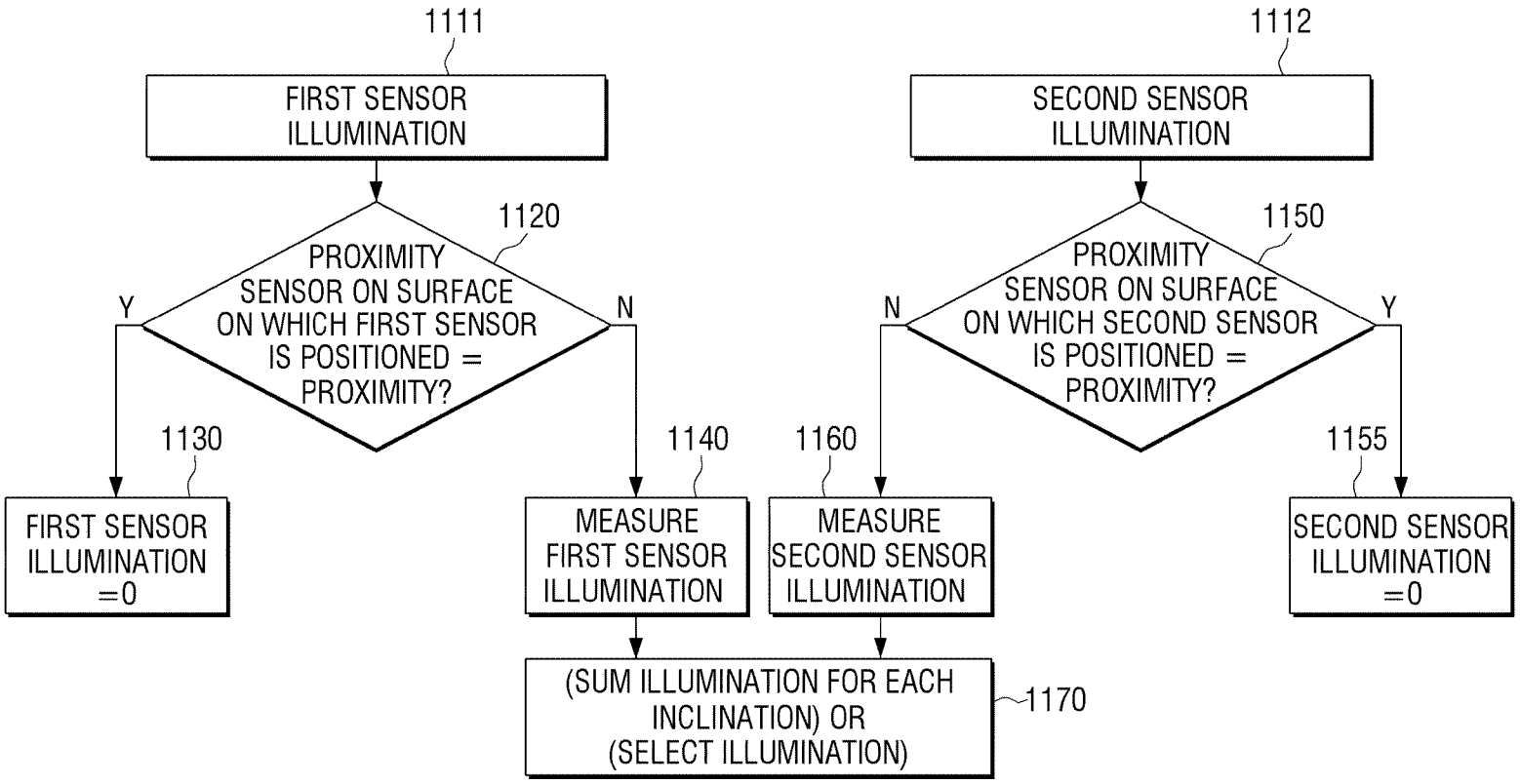
FIG. 11 is a diagram illustrating a method for calculating illumination according to an exemplary embodiment.

FIG. 11 is a diagram illustrating a method for calculating illumination according to an exemplary embodiment.

Referring to FIG. 11, illumination may be calculated based on a sensing result of proximity sensors provided on front and rear surfaces on which the first sensor 120 and the second sensor 130 are provided. For example, an IR sensor or the like may be used as the proximity sensor provided on the rear surface, but is not limited thereto. This is based on a principle in which sensing data of a corresponding illumination sensor is reliable only when there is no approaching person or object, in that the reliability of sensing data of the illumination sensor is lowered when a person or an object approaches.

As illustrated, when proximity of an object is detected by a proximity sensor positioned on a surface of the first sensor 120 (1120:Y), reliability of the illumination 1011 sensed by the first sensor 120 is lowered, and thus the illumination 1111 sensed by the first sensor 120 may be disregarded (1130), and only when proximity is not detected by the proximity sensor (1120:N), the illumination 1111 sensed by the first sensor 120 may be used (1140).

In addition, like the first sensor 120, when proximity of an object is detected by a proximity sensor positioned on a surface of the second sensor 130 (1150:Y), reliability of the illumination 1112 sensed by the second sensor 130 is disregarded, and thus the illumination 1112 sensed by the second sensor 130 may be disregarded (1155), and only when proximity is not detected by the proximity sensor (1150:N), illumination sensed by the second sensor 130 may be used (1160).

In detail, only when proximity of an object is not detected on a surface on which each sensor is provided, illumination may be calculated in consideration of inclination using the illumination 1111 sensed by the first sensor 120 and the illumination 1112 sensed by the second sensor 130 via the various methods described with reference to FIGS. 9A and 9B (1170).

Figure 12A:
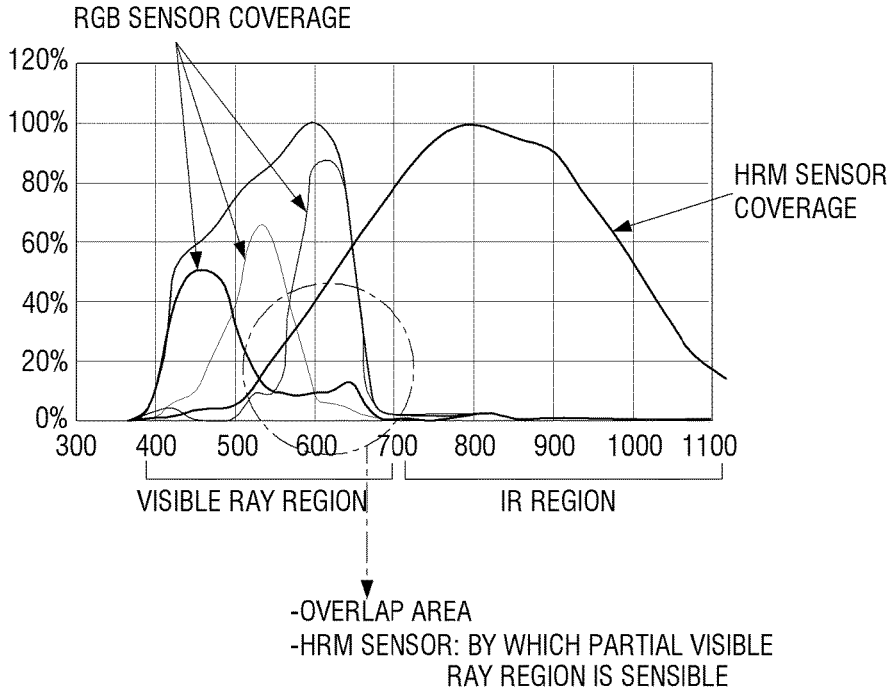
FIGS. 12A and 12B are diagrams illustrating an illumination sensor according to an exemplary embodiment.
Figure 12B:
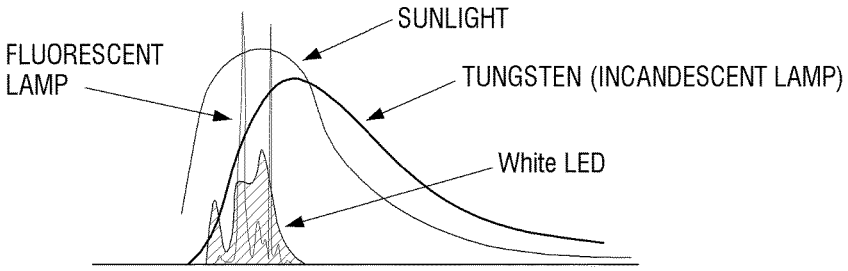

FIGS. 12A and 12B are diagrams illustrating an illumination sensor according to an exemplary embodiment.

FIG. 12A is a diagram illustrating a case in which a heart rate monitor (HRM) sensor provided on a rear surface of the user terminal device 100 is used as the second sensor 130 according to an exemplary embodiment.

In general, the HRM sensor may sense both visible light rays and infrared light rays in order to measure a heart rate of a user. As illustrated in FIG. 12A, the HRM sensor may sense a portion of a visible ray region. Accordingly, the HRM sensor may be used instead of the second sensor 130.

In detail, many indoor spaces include fluorescent lamp and/or light emitting diode (LED) illumination. As illustrated in FIG. 12B, since the fluorescent lamp and the LED illumination have insignificant IR components, when light emitted therefrom is sensed by the HRM, only the visible light rays are sensed. That is, under the fluorescent lamp and the LED illumination, the HRM sensor has high reliability as an illumination sensor. However, sunlight and tungsten-based light bulbs include significant IR components, and thus when light is sensed by the HRM sensor, a sensed value is high. In this case, the sensed value may downscaled and used. That is, when the HRM sensor is used as a rear illumination sensor, the characteristics of a light source need to be analyzed in order to estimate illumination. For example, whether an illumination of a space in which an object is currently positioned is a fluorescent lamp or an incandescent lamp may be determined and a scaling factor corresponding thereto may be applied.

Figure 13:
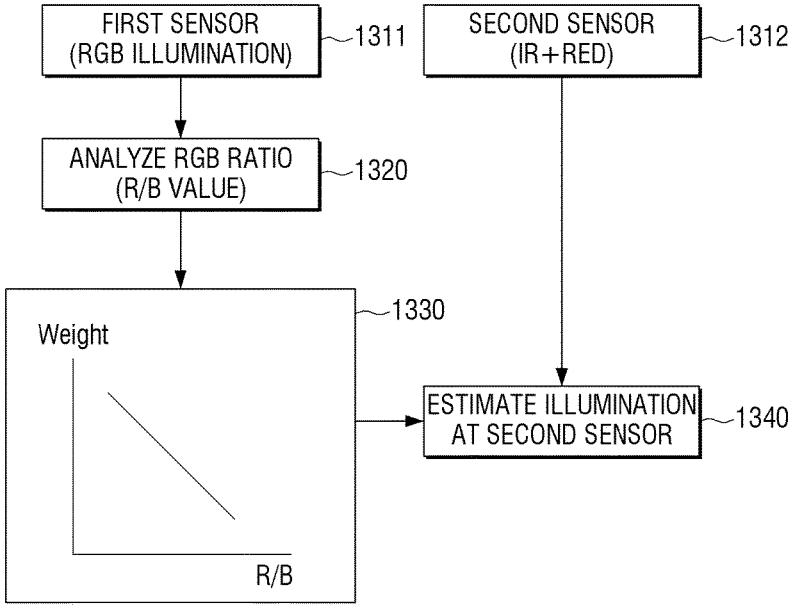
FIG. 13 is a diagram illustrating a method for estimating a type of a light source according to an exemplary embodiment.

FIG. 13 is a diagram illustrating a method for estimating a type of a light source according to an exemplary embodiment.

According to an exemplary embodiment, when a front illumination sensor is embodied as an RGB sensor and a rear illumination sensor is embodied as an HRM sensor, a type of a light source of a space in which a user is positioned may be determined using a sensing value of the RGB sensor.

In detail, as illustrated in FIG. 13, an R/G/B ratio of a sensing value 1311 sensed by the RGB sensor may be analyzed (1320) and a weight corresponding to the analyzed ratio, that is, the light source type may be acquired (1330). In this case, as illustrated, a weight corresponding to the R/G/B ratio may be acquired based on predefined mapping information (e.g., a graph formed by mapping an R/G/B ratio and a weight).

Then, the acquired weight may be applied to a value 1312 sensed by the second sensor 130, that is, the HRM sensor, to calculate an estimated value of illumination of the second sensor (1340). For example, the value 1312 sensed by the HRM sensor may be multiplied by a weight to calculate an estimated value of illumination.

For example, since an incandescent lamp (bulb color) contains more red wavelength ranges than blue wavelength ranges, high R/B values may be obtained from a value sensed by the first sensor 120, that is, a front RGB sensor. In this case, a high HRM sensing value may be obtained compared with illumination, and thus the HRM sensing value may be corrected by reducing an applied weight. However, a low R/B value is sensed compared with an incandescent lamp with respect to the LED, and thus illumination may be estimated from the HRM sensing value by increasing the applied weight in this case.

However, the aforementioned embodiment is merely an exemplary embodiment, and as necessary, the value 1312 sensed by the HRM sensor may be directly used as an illumination value rather than being corrected or may be simply scaled and used as an illumination value. For example, rear illumination=rear HRM sensing value*K (fixed simple scaling factor) may be calculated.

Figure 14:
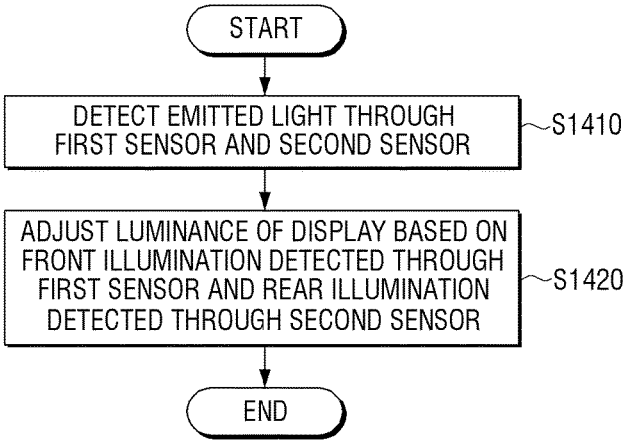
FIG. 14 is a flowchart illustrating a method for adjusting luminance of a user terminal apparatus according to an exemplary embodiment.

FIG. 14 is a flowchart illustrating a method for adjusting luminance of a user terminal apparatus according to an exemplary embodiment.

According to a method for adjusting luminance of a user terminal apparatus including a first sensor that is provided on a front surface of a user terminal apparatus according to an exemplary embodiment illustrated in FIG. 14 and detects emitted light and a second sensor that is provided on a rear surface of the user terminal apparatus and detects emitted light, the first sensor and the second sensor may detect emitted light (S1410).

Then luminance of a display provided on the front surface may be adjusted based on front illumination detected through the first sensor and rear illumination detected through the second sensor (S1420).

In operation S1420 for adjusting the luminance of the display, whether an illumination space is changed may be determined based on instantaneous variation of the front illumination and instantaneous variation of the rear illumination, and when it is determined that the illumination space is changed, luminance of the display may be adjusted so as to correspond to the changed illumination space.

In operation S1420 for adjusting the luminance of the display, when the instantaneous variation of the front illumination and instantaneous variation of the rear illumination are equal to or more than a predetermined threshold value and variation directions thereof are identical to each other, luminance of a display may be adjusted at a time point when the illumination space is changed.

In addition, in operation S1420 for adjusting luminance of display, when instantaneous variations of the front illumination and rear illumination are positive numbers, an illumination space may be determined to be relatively changed to a light space from a dark space, and, when instantaneous variations of the front illumination and rear illumination are negative numbers, the illumination space may be determined to be relatively changed to a dark space from a light space.

In operation S1420 for adjusting luminance of the display, a backlight situation may be determined based on a comparison result of the front illumination and the rear illumination, and when a current situation is determined to be a backlight situation, luminance of the display may be adjusted to correspond to the backlight situation.

In operation S1420 for adjusting luminance of the display, when a current situation is determined to be a backlight situation, luminance of the display may be increased compared with current luminance.

In operation S1420 for adjusting luminance of the display, when a current situation is determined to be a backlight situation, an intensity of the backlight may be calculated and a value obtained by increasing luminance may be calculated based on the intensity of backlight.

In operation S1420 for adjusting luminance of the display, the intensity of backlight may be calculated based on at least one of a ratio, a difference value, and a mathematical calculation combination of front illumination and rear illumination.

In operation S1420 for adjusting luminance of the display, when a current situation is determined to be a backlight situation, luminance of display may be adjusted based on the rear illumination or a higher weight than the front illumination may be applied to the rear illumination to adjust luminance of the display to the calculated luminance value.

As described above, according to the diverse exemplary embodiments, when illumination is measured using an optical sensor, measurement error may be minimized and measurement accuracy may be enhanced. That is, it may be possible to sense optimum illumination by combining device inclination information and proximity information of an object using a plurality of illumination data items. Accordingly, it may be possible to sense illumination with high reliability even under various unfavorable conditions such as user movement or inclination and shadow.

In addition, it may be possible to accurately determine a time point of change of an illumination space. In particular, "minimum sensing delay time" that is conventionally present may be drastically reduced in terms of development of an illumination sensor. Accordingly, a high performance and rapid illumination sensing device may be developed. Here, in order to prevent instantaneous measurement error due to user shadow or dynamic external environments, sensing values may be accumulated or a sensing value may be determined to be a true value only when variation in the sensing value is maintained for predetermined time or more when the sensing value is varied. In this regard, the "minimum sensing delay time" may refer to delay time required to this objective.

In addition, physical optical sensing coverage may be enlarged. Conventionally, a diffuser is installed on a single optical sensor. However, according to the diverse exemplary embodiments, two or more sensors may be simultaneously used, and thus there may be many instrumental advantages in terms of a measurement direction and range.

In addition, it may be possible to accurately detect a backlight situation and to recognize intensity of the backlight. Due to the characteristics of a mobile electronic device, the device may be frequently present in a backlight situation. In particular, a user of a mobile device may frequently face a backlight situation at the window in the daytime. In this case, when display luminance is controlled by accurately detecting a backlight situation and backlight intensity, optimum visibility may be ensured.

In addition, it may be possible to control optimum display luminance in consideration of a visual system (VS). As described above, it may be possible to optimize luminance without irritation in terms of a user's visual perception by maintaining luminance constancy in the same space and adjusting luminance when an illumination space is changed.

The method for adjusting luminance of a user terminal device according to the diverse exemplary embodiments may be embodied as a program and provided to a user terminal device.

For example, a non-transitory computer readable medium may be provided for storing a program for an operation of executing detecting light emitted through a first sensor provided on a first surface of a user terminal device and a second sensor provided on a rear surface of the user terminal device and adjusting luminance of display based on front illumination detected through the first sensor and rear illumination detected through the second sensor.

The non-transitory computer readable medium is a medium which does not store data temporarily such as a register, cache, or memory but stores data semi-permanently and is readable by other devices. More specifically, the aforementioned applications or programs may be stored in the non-transitory computer readable media such as compact disks (CDs), digital video disks (DVDs), hard disks, Blu-ray disks, universal serial buses (USBs), memory cards, and read-only memory (ROM).

The foregoing exemplary embodiments and advantages are merely exemplary and are not to be construed as limiting in any way. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A user terminal device comprising:

a display in which a backlight is installed, the display being provided on a front surface of the user terminal device;

a first sensor provided on the front surface of the user terminal device and configured to identify a front illumination external to the user terminal device, the display, and the backlight;

a second sensor provided on a rear surface of the user terminal device and configured to identify a rear illumination external to the user terminal device, the display, and the backlight;

a third sensor configured to detect an inclination of the user terminal device; and a controller configured to:

identify whether a ratio of the rear illumination over the front illumination is greater than a predetermined threshold ratio;

based on the ratio of the rear illumination over the front illumination being identified to be greater than the predetermined threshold ratio, identify that a current situation is a backlight situation;

based on the current situation being identified to be the backlight situation, identify an intensity of the backlight based on the ratio;

adjust a first luminance of the display, based on the intensity of the backlight that is identified;

acquire, from a lookup table, a first weight to be applied to the front illumination and a second weight to be applied to the rear illumination, the first weight and the second weight corresponding to the inclination that is detected;

apply the first weight that is acquired, to the front illumination; and apply the second weight that is acquired, to the rear illumination.

2. The user terminal device of claim 1, wherein the controller is further configured to:

identify that an illumination space is changed based on a first variation of the front illumination and a second variation of the rear illumination; and based on the illumination space being identified to be changed, adjust the first luminance of the display, based on a second luminance of the illumination space that is changed.

3. The user terminal device of claim 2, wherein the controller is further configured to identify that the illumination space is changed, based on each of the first variation of the front illumination and the second variation of the rear illumination being greater than or equal to a predetermined threshold variation or being less than the predetermined threshold variation.

4. The user terminal device of claim 3, wherein the controller is further configured to:

based on each of the first variation of the front illumination and the second variation of the rear illumination being greater than or equal to the predetermined threshold variation, identify that the illumination space is relatively changed from a darker space to a lighter space; and based on the first variation of the front illumination and the second variation of the rear illumination being less than the predetermined threshold variation, identify that the illumination space is relatively changed from a lighter space to a darker space.

5. The user terminal device of claim 1, wherein the controller is further configured to increase the first luminance of the display, based on the current situation being identified to be the backlight situation.

6. The user terminal device of claim 5, wherein the controller is further configured to identify a target luminance of the display, based on the intensity of the backlight that is identified.

7. The user terminal device of claim 1, wherein the controller is further configured to, based on the current situation being identified to be the backlight situation, adjust the first luminance of the display to a luminance value that is identified by applying a higher weight to the rear illumination than the front illumination that are identified.

8. The user terminal device of claim 1, wherein each of the first sensor and the second sensor comprises any one or any combination of an RGB sensor, a white sensor, an IR sensor, an IR+RED sensor, a heart rate monitor (HRM) sensor, and a camera.

9. A user terminal device comprising:

a display in which a backlight is installed, the display being provided on a front surface of the user terminal device;

a first sensor provided on the front surface of the user terminal device and configured to identify a front illumination external to the user terminal device, the display, and the backlight;

a second sensor provided on a rear surface of the user terminal device and configured to identify a rear illumination external to the user terminal device, the display, and the backlight; and a controller configured to:

identify whether a ratio of the rear illumination over the front illumination is greater than a predetermined threshold ratio;

based on the ratio of the rear illumination over the front illumination being identified to be greater than the predetermined threshold ratio, identify that a current situation is a backlight situation;

based on the current situation being identified to be the backlight situation, identify an intensity of the backlight, based on the ratio; and adjust a first luminance of the display, based on the intensity of the backlight that is identified, wherein the first sensor comprises an RGB sensor configured to sense a first sensing value, the second sensor comprises a heart rate monitor (HRM) sensor configured to sense a second sensing value, and the controller is further configured to:

acquire, from predefined mapping information, a weight corresponding to an RGB ratio of the first sensing value sensed by the RGB sensor; and apply the weight that is acquired, to the second sensing value sensed by the HRM sensor.

10. A method of adjusting luminance of a user terminal device comprising a display in which a backlight is installed, the display being provided on a front surface of the user terminal device, a first sensor provided on the front surface of the user terminal device, a second sensor provided on a rear surface of the user terminal device, and a third sensor, the method comprising:

identifying, by the first sensor, a front illumination external to the user terminal device, the display, and the backlight;

identifying, by the second sensor, a rear illumination external to the user terminal device, the display, and the backlight;

detecting, by the third sensor, an inclination of the user terminal device;

identifying whether a ratio of the rear illumination over the front illumination is greater than a predetermined threshold ratio;

based on the ratio of the rear illumination over the front illumination being identified to be greater than the predetermined threshold ratio, identifying that a current situation is a backlight situation;

based on the current situation being identified to be the backlight situation, identifying an intensity of the backlight based on the ratio;

adjusting a first luminance of the display, based on the intensity of the backlight that is identified;

acquiring, from a lookup table, a first weight to be applied to the front illumination and a second weight to be applied to the rear illumination, the first weight and the second weight corresponding to the inclination that is detected;

applying the first weight that is acquired, to the front illumination; and applying the second weight that is acquired, to the rear illumination.

11. A user terminal device comprising an automatic luminance adjusting function, the user terminal device comprising:

a display in which a backlight is installed, the display being provided on a first side of the user terminal device;

a first sensor provided on the first side of the user terminal device and configured to measure a first received luminance external to the user terminal device, the display, and the backlight;

a second sensor provided on a second side of the user terminal device and configured to measure a second received luminance external to the user terminal device, the display, and the backlight;

a third sensor configured to detect an inclination of the user terminal device; and one or more processors configured to:

identify whether a ratio of the second received luminance over the first received luminance is greater than a predetermined threshold ratio;

based on the ratio of the second received luminance over the first received luminance being identified to be greater than the predetermined threshold ratio, identify that a current situation is a backlight situation;

based on the current situation being identified to be the backlight situation, identify an intensity of the backlight based on the ratio;

identify a target luminance of the display, based on the intensity of the backlight that is identified;

adjust an actual luminance of the display, based on the target luminance of the display that is identified; and correct the target luminance of the display that is identified, based on the inclination that is detected.

12. The user terminal device of claim 11, wherein the one or more processors are further configured to identify a first illumination space comprising a first illumination environment and a second illumination space comprising a second illumination environment, based on the first received luminance and the second received luminance that are measured.

13. The user terminal device of claim 12, wherein the one or more processors are further configured to:

identify, based on the first received luminance and the second received luminance that are measured, a change from the first illumination environment to the second illumination environment; and adjust a target display luminance, based on the change that is identified.

14. The user terminal device of claim 11, wherein the display is further configured to display an image, and the one or more processors are further configured to control a partial luminance of a first region of the image independently from a second region of the image.

15. The user terminal device of claim 11, further comprising a proximity sensor provided on the second side of the user terminal device and configured to identify a motion, wherein the one or more processors are further configured to identify the target luminance of the display, based on a weighted combination of the first received luminance and the second received luminance that are measured.

16. The user terminal device of claim 15, wherein the one or more processors are further configured to identify the target luminance of the display, based on only the first received luminance that is measured, based on the motion being identified by the proximity sensor.

17. The user terminal device of claim 11, wherein the second sensor is further configured to measure a heart rate of a user.

* * * * *